United States Patent [19]

Lindley et al.

[11] Patent Number: 4,848,742

[45] Date of Patent: Jul. 18, 1989

[54] LUMBAR STRETCH ROCKER

[76] Inventors: William L. Lindley; Delores H. Lindley, both of P.O. Box 300109, Houston, Tex. 77320

[21] Appl. No.: 180,185

[22] Filed: Apr. 11, 1988

[51] Int. Cl.[4] ..... A63B 23/02

[52] U.S. Cl. ..... 272/144; 128/69

[58] Field of Search ..... 272/93, 114, 144, 115, 272/146, 145, 94, 97, 111, 33 A, 33 R, 55, 120, 127; 128/69, 68, 72, 74, 134

[56] References Cited

U.S. PATENT DOCUMENTS

| | | | |
|---|---|---|---|
| 4,193,592 | 3/1980 | Bishow | 272/114 |
| 4,613,131 | 9/1986 | Anderson | 272/33 A |
| 4,700,945 | 10/1987 | Rader | 272/120 |
| 4,752,067 | 6/1988 | Colo | 272/93 |

FOREIGN PATENT DOCUMENTS

| | | | |
|---|---|---|---|
| 2605319 | 8/1977 | Fed. Rep. of Germany | 272/146 |
| 3508705 | 9/1985 | Fed. Rep. of Germany | 272/146 |
| 2510895 | 2/1983 | France | 272/146 |

*Primary Examiner*—Richard J. Apley
*Assistant Examiner*—Howard Flaxman
*Attorney, Agent, or Firm*—Pravel, Gambrell, Hewitt, Kimball & Krieger

[57] ABSTRACT

This invention is an exercise apparatus upon which the user rests his or her hips and feet while lying on a flat surface such as a floor. It provides means by which a user can pull or push with the hands and feet while the user oscillates, rocks, or rotates his body to stretch or relax the back muscles. It can be used directly on a flat surface or on a base.

9 Claims, 2 Drawing Sheets

FIG. 1
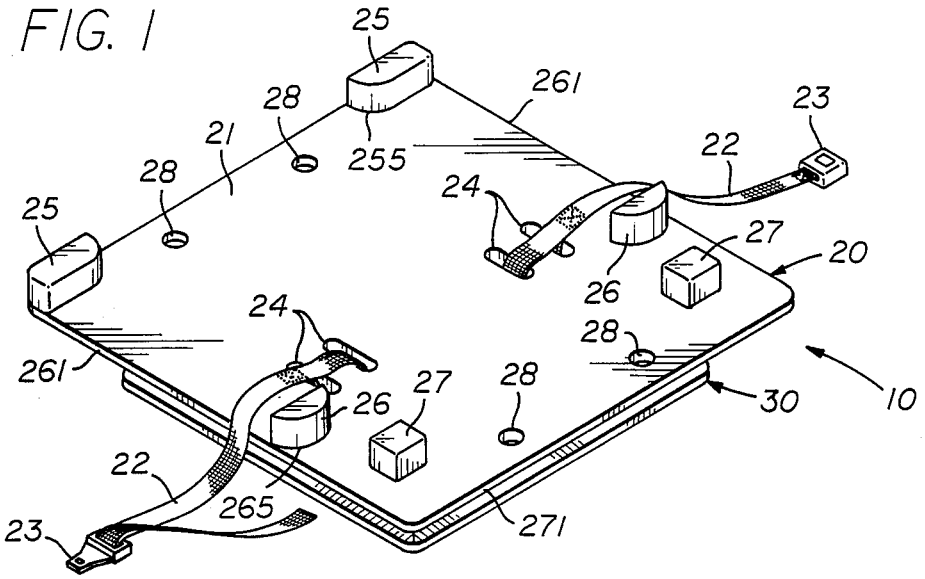
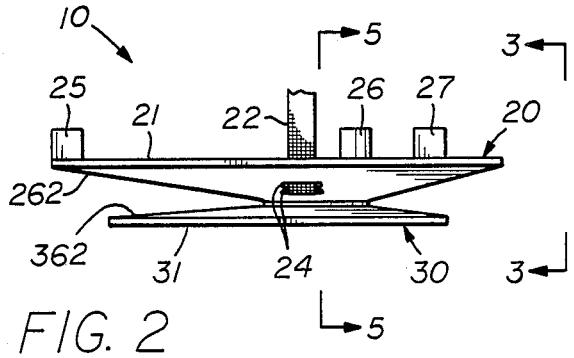
FIG. 2
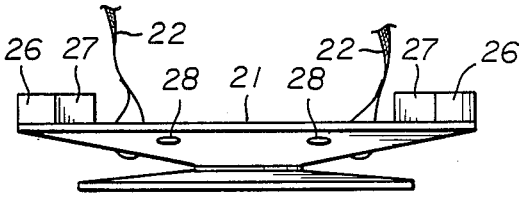
FIG. 3
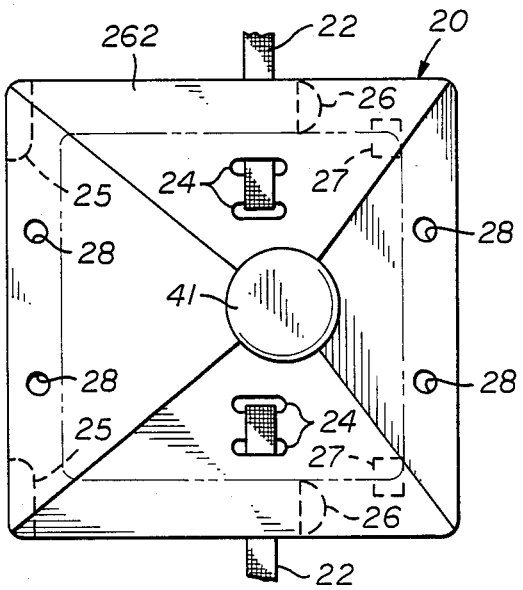
FIG. 4
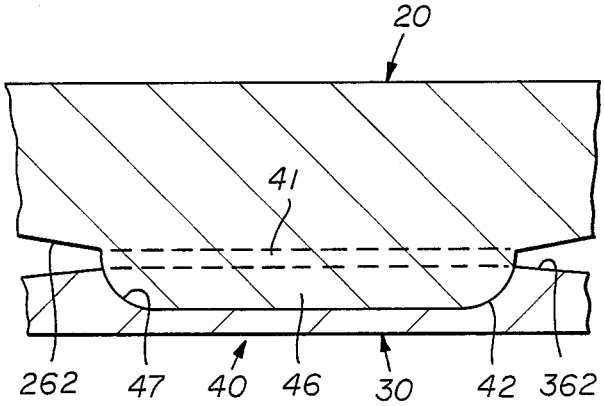
FIG. 5

LUMBAR STRETCH ROCKER

This is a continuation-in-part of co-pending Ser. No. 011,939, filed on Feb. 6, 1987, and abandoned.

BACKGROUND OF THE INVENTION

1. Field of the Invention

This invention relates to an article of exercise equipment adapted for home use or clinic use. It is suitable for exercise for the purpose of relaxation as well as therapy. The user places the apparatus on the floor or on another flat surface, lies on it, straps himself down and rocks, twists or otherwise moves in various directions to selectively and alternately loosen, stretch and relax the back muscles.

This exercise is particularly beneficial to loosen the back muscles and spinal column and relieve pain which may be caused by their rigidity. Almost every activity engaged in by humans involves stressing the spine, including lifting, running, playing golf, bowling, dancing, and even standing or walking. They all press downward on the spine and the spinal discs, and the discs can rupture or become swollen and painful. The back muscles attempt to hold the spine in alignment, eventually going into spasm. It is this muscle spasm that the lumbar stretch rocker is designed to alleviate. First, it can stretch and relax the muscles, directly alleviating the pain; second, it can strenghten the muscles, enabling them to do their job without going into spasm. This invention allows the user to stretch the muscles in any way necessary to cause them to relax. The user accomplishes this by stretching against the muscle tension and allowing the tensed muscle to relax.

Other exercise equipment such as rowing machines and weight lifting apparatus are designed to strengthen muscles by repeated flexion under stress, which can exacerbate the spasm condition rather than alleviate it. The only known way to relax these muscles is through manipulation by massage or through medication.

2. Description of the Prior Art

There are no devices known to the applicant which are in any way similar to this invention or which perform the same function. However, attention is directed to copending patent application Ser. No. 846,207 and the prior art cited therein.

SUMMARY OF THE INVENTION

The apparatus of this invention is a novel exercise device which is constructed so as to facilitate selective rocking, oscillating, or rotating motion by the user. A base plate may be provided to facilitate use of the device on a soft surface, such as a bed.

BRIEF DESCRIPTION OF THE DRAWINGS

Further details are provided below as exemplified by these attached drawings:

FIG. 1 is a perspective view of the invention including the optional baseplate;

FIG. 2 is a side elevation of the apparatus of FIG. 1.

FIG. 3 is an end view taken on line 3—3 of FIG. 2;

FIG. 4 is a bottom view showing the bottom structure;

FIG. 5 is a partial enlarged section showing the mating of the rocker with its base plate.

DESCRIPTION OF THE PREFERRED EMBODIMENTS

Figure 6:
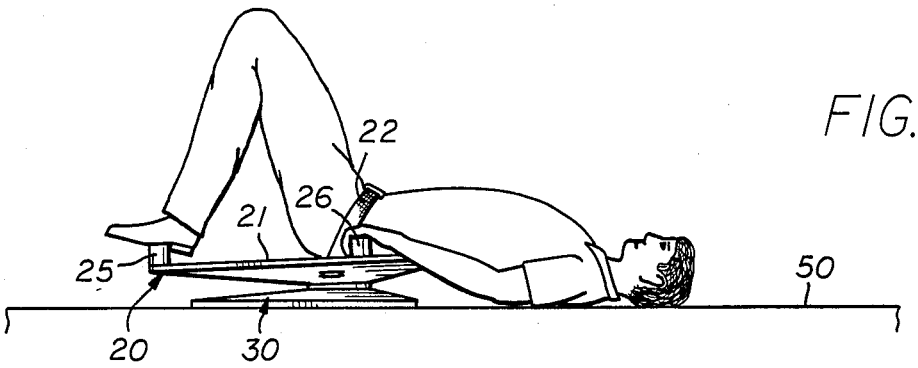
FIGS. 6 through 9 are illustrations of some modes of use of the apparatus.

In the drawings, the rocker 10 has a support board 20 with a top surface 21 where the user lies with his hips and legs supported by the apparatus and his upper body supported by the floor 50 or other surface upon which the apparatus rests. The rocker 10 also has a base 30 with a bottom surface 31 which rests upon the floor, table, bed, or other surface. The support board 20 can move relative to the base 30 because of the pivotable construction of the joint 40 between the two, shown in FIG. 5.

The user is secured to the support board 20 by a restraining strap 22 and a releasable fastening device such as buckle 23. This strap 22 is located at or near the mid-portion of board 20 and in use is fastened around the hips of the user as shown in FIGS. 6 through 9. The strap 22 is secured to the support board 20 by being looped through slots 24, or one continuous strap (not shown) could be run through slots 24, traversing the center of the support board 20 on its top surface 21 so as not to interfere with joint 40. The user's heels or feet are supported by two raised foot-receiving bosses 25 to position the legs in the bent-knee position shown in FIGS. 6 and 7. Hand-receiving bosses 26 near the edges 261 of the board at the user's sides, and hand-receiving bosses 27, further from the edges 261 of the board at the user's sides but closer to the edge 271 of the board opposite the foot-receiving bosses 25, are provided so that the user can push or pull with his hands as shown in FIGS. 6 through 9. Holes 28 are provided in support board 20 for the attachment of a cushion, heater, vibrator, or other accessory (not shown).

Support board 20 preferably has four surfaces 262 on its bottom which slope to a cylindrical projection 41 which has rounded contours 42 on its downward end. This forms the male part of a pivotable joint 40. The four surfaces 262 form the lower or second surface of the apparatus and they project downwardly, generally in the shape of a pyramid truncated near its apex, with a substantially circular or round boss at the apex, having the rounded contours 42. Base 30 has four surfaces 362 on its top which slope to a concave surface 46 which has rounded contours 47 which match rounded contours 42. This forms the female part of pivotable joint 40. This joint facilitates movement of the support board 20 with respect to the base 30 in a rocking, rotating, or oscillating fashion. The projection 41 is located substantially beneath the restraining strap 22.

If the surface 50 upon which the rocker 10 is used is sufficiently flat and hard, it is possible to use support board 20 directly on such surface without using base 30. If the rocker 10 is used on a soft surface such as a bed, however, it will usually be necessary to use both support board 20 and base 30.

Foot-receiving bosses 25 and hand-receiving bosses 26 are shown with radiused corners 255 and 265, respectively, for user comfort, but these bosses could have a variety of shapes to provide comfort or utility. Placement of bosses 25, 26, and 27 could also be modified, and bosses could be omitted or added, within the scope of the invention.

Figure 7:
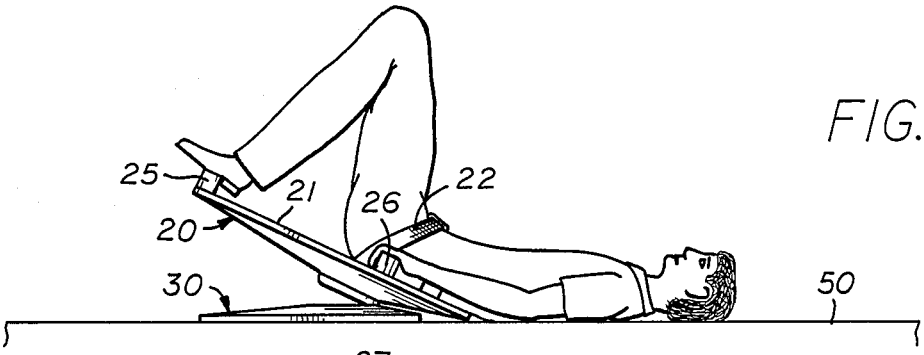

In the use of the apparatus of this ivention, as illustrated in FIGS. 6 through 9, there are two basic types of motion to perform, but each user should experiment to find the exercises that most effectively relieve his pain. FIGS. 6 and 7 illustrate a basic rocking motion. In FIG.

6, the user is pushing with the heels or other part of the foot on foot-receiving bosses 25 and pulling on hand-receiving bosses 26 while being restrained at the hips by strap 22. This rocks the end of support board 20 near foot-receiving blocks 25 toward the floor 50 and raises the end of support board 20 near the user's waist away from the floor 50. The user's shoulders remain on the floor 50, resulting in a concave curve in the lower backbone and stretching of the stomach muscles. The user then relieves the pressure with his heels or feet and pushes on hand-receiving bosses 26 with the user's hands as shown in FIG. 7. The hips of the user are restrained by the restraining strap 22 during such pushing on the hand-receiving bosses 26 by the user. As before, the user's shoulders remain on the floor 50. This results in a convex curve in the lower backbone and stretching of the muscles in the lower back. It also extends the backbone relieving pressure on the tender discs. Alternating gently between these two positions or remaining in the position which relieves the pain can relax the muscles which are in spasm.

Figure 8:
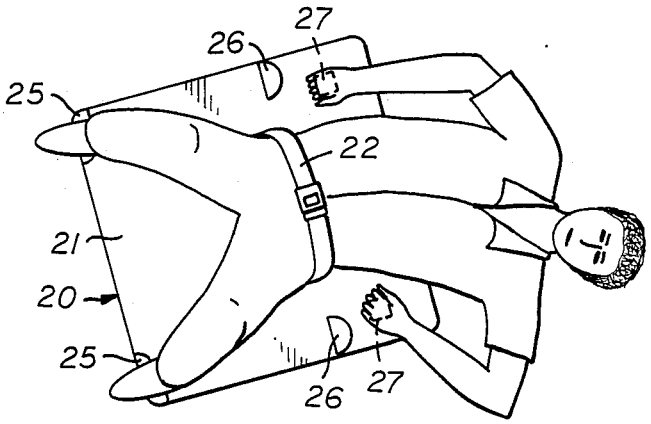
Figure 9:
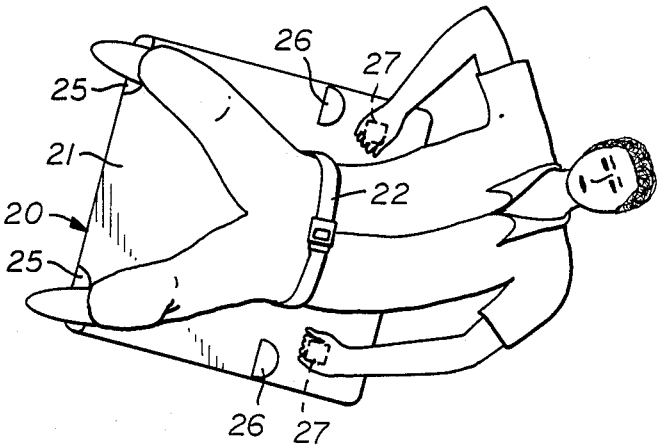

A second basic motion is illustrated in FIGS. 8 and 9. The user is positioned on support board 20 as before, with the shoulders resting on the floor 50. In FIG. 8, the user pushes on one hand-receiving boss 27 with his right hand while pulling on the other hand-receiving boss 27 with his left hand, resulting in rotation of his lower body counter-clockwise as shown in the figure. This can stretch and relax the muscles in the right side of the lower back.

FIG. 9 shows the user pushing on one hand-receiving boss 27 with his left hand while pulling on the other hand-receiving boss 27 with his right hand, resulting in rotation of the lower body clockwise as shown in the figure. This can stretch and relax the muscles in the left side of the lower back. Alternating gently between these movements of selecting th most effective one and holding it can relieve tension in the appropriate muscles.

In either the rocking or the rotating movements, the user can use hand-receiving bosses 26 or 27 as desired according to his particular build, and one hand can use a boss 26 while the other hand uses a boss 27. These movements can be combined as desired to create an oscillating motion, or leg-crossing exercises can be performed to stretch by twisting the lower torso.

Although the board 20 has been illustrated as having a square shape, the invention is not limited to such shape. However, the arrangement of the foot-receiving bosses 25 and hand-receiving bosses 26 are in a generally square or rectangular configuration on the board 20, regardless of the shape of the board itself.

It should be understood that the foregoing description and the drawings of the invention are not intended to be limiting, but are only exemplary of the invention features which are defined in the claims.

What is claimed is:

1. An apparatus for exercising the lower back muscles comprising:

a support board having an upper surface which is substantially flat for supporting the lower portion of the body of the user in a supine position;

a restraining strap mounted with said board near the mid-portion of said board for securing the user to said upper surface at the hips;

a pair of foot-receiving bosses on said upper surface substantially at one end of said board to provide resting places for the feet of the user while holding the knees in an upwardly bent position;

a pair of hand-receiving bosses on said upper surface substantially at the opposte end of said board from said foot-receiving bosses and disposed on the other side of said strap from said foot-receiving bosses to provide for the user to push against them with the user's hands while the hips are restrained by said strap to stretch the back muscles and the spinal column; and said board having a lower surface on the opposite side from said upper surface, said lower surface having a downwardly extending projection near the mid-portion of said board so as to be substantially beneath said restraining strap but is offset from the mid-portion of said support board in a direction towards said hand-receiving bosses so that the portion of said support board on the side of said pivot projection which is below said hand-receiving bosses is shorter than the portion of said support board which is on the side of said pivot projection which is below said foot-receiving bosses to enable the board to be rocked and moved be the user.

2. An apparatus for selectively stretching, twisting, and relaxing the back muscles of a user, comprising:

a support board having an upper surface for supporting the lower portion of the body of a user in a supine position;

feet-receiving means substantially at one end of said upper surface for supporting the feet of the user on said upper surface in a bent-knee position;

hand-receiving means substantially at the opposite end of said upper surface from said feet-receiving means for enabling the user to push with the user's hands;

restraint means located near the mid-portion of said support board between said feet-receiving means and said hand-receiving means for releasably securing the user to said upper surface at the hips;

said restraint means holding the hips against movement on said board when the user pushes against said hand receiving means with the user's hands, and providing resistance to a pushing force by the user with the feet; and said board having a lower surface with a downwardly extending pivot projection thereon in an area of said lower surface which is substantially below said restraint means but if offset from the mid-portion of said support board in a direction towards said hand-receiving means so that the portion of said support board on the side of said pivot projection which is below said hand-receiving means is shorter than the portion of said support board which is on the side of said pivot projection which is below said foot-receiving means to allow the user to manipulate the board to various angular and tilting movements while the user's lower body is on the board.

3. The apparatus of claim 2, wherein:

said pivot means is formed by a downwardly extending projection at about the mid-portion of said board to enable the board to be rocked and moved by the user.

4. The apparatus of claim 3, further comprising:

said downwardly extending projection having a rounded contour on the downward end to form the male half of a pivotable joint;

a base having a concave surface matching said rounded contour on said downwardly extending projection to form the female half of said pivotable joint; and said base having a second surface, on the opposite side from said concave surface, which is flat.

5. The apparatus of claim 2, wherein:

said foot-receiving means and said hand-receiving means are arranged on said board in a generally rectangular configuration.

6. The apparatus of claim 1, wherein:

said restraint means is a strap extending across said board in an area substantially directly above said pivot means.

7. The apparatus of claim 1, wherein:

said board is substantially rectangular;

said foot-receiving means comprises a foot-receiving member in proximity to two adjacent corners of said board; and said hand-receiving means comprises a hand-receiving member in proximity to the other two adjacent corners of said board.

8. An apparatus for selectively stretching, twisting, and reaxing the back muscles of a user, comprising:

a support board having an upper surface for supporting the lower portion of the body of a user in a supine position and a lower surface adapted to be positioned on the ground or on a base;

a restraining strap extending laterally across the mid-portion of said board and having a releasable fastening means therewith for releasably securing the user to said upper surface at the user's hips;

a first pair of upwardly projecting bosses on said upper surface to one side of said central portion and spaced from each other and from said strap a sufficient distance to enable the feet of the user to be positioned on the board when the strap is secured about the user's hips so that the user's legs are in a bent-knee position, providing resistance to a pushing force by the legs of the user;

a second pair of upwardly projecting bosses on said upper surface and disposed to the other side of said strap from said first pair of bosses on said upper surface for enabling the user to push the user's upper body with the user's hands;

said first pair of bosses and said second pair of bosses being arranged in a generally rectangular configuration, with said strap extending across the board between said first pair of bosses and said second pair of bosses; and said lower surface having a pivot projection extending downwardly at the mid-portion of said board to position the rest of said lower surface away from the ground or base when the projection rests on the ground or base; and said pivot projection being disposed substantially beneath said strap but is offset from the mid-portion of said support board in a direction towards said hand-receiving bosses so that the portion of said support board on the side of said pivot projection which is below said hand-receiving bosses is shorter than the portion of said support board which is on the side of said pivot projection which is below said foot-receiving bosses to allow the user to manipulate the board and the lower body of the user therewith in various movements relative to the user's upper body which is resting on the floor.

9. The apparatus of claim 6, wherein:

said pivot projection is generally in the shape of a pyramid truncated near its apex.

* * * * *

UNITED STATES PATENT AND TRADEMARK OFFICE

CERTIFICATE OF CORRECTION

PATENT NO. : 4,848,742

DATED : July 18, 1989

INVENTOR(S) : William L. Lindley; Delores H. Lindley

It is certified that error appears in the above-identified patent and that said Letters Patent is hereby corrected as shown below:

Col. 3, line 38 should read: these movements or selecting the most effective one and Col. 4, line 49 should read: below said restraint means but is offset from the The address of inventors should read: Houston, Tex. 77230

Signed and Sealed this

Twenty-second Day of May, 1990

*Attest:*

*Attesting Officer*

HARRY F. MANBECK, JR.

*Commissioner of Patents and Trademarks*